US007564325B2

(12) United States Patent
Hussain et al.

(10) Patent No.: US 7,564,325 B2
(45) **Date of Patent: *Jul. 21, 2009**

(54) HIGH DIRECTIVITY ULTRA-COMPACT COUPLER

(75) Inventors: Abid Hussain, Methuen, MA (US); Daniel J. Donoghue, Tewksbury, MA (US); Eric S. Gray, Westford, MA (US)

(73) Assignee: Fairchiled Semiconductor Corporation, South Portland, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/675,564

(22) Filed: Feb. 15, 2007

(65) Prior Publication Data

US 2008/0197937 A1 Aug. 21, 2008

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 112, 113, 116, 238
See application file for complete search history.

(56) References Cited

U.S. PATENT DOCUMENTS 5,634,208 A * 5/1997 Nishikawa et al. ..... 455/327
6,483,398 B2 11/2002 Nagamori et al.
6,512,423 B2 * 1/2003 Koga ..... 333/1
6,603,960 B1 8/2003 Oida et al.
6,987,428 B2 * 1/2006 Marketkar et al. ..... 333/24 R
7,034,633 B2 * 4/2006 Passiopoulos et al. ..... 333/116
7,088,201 B2 * 8/2006 Piernas ..... 333/116
7,336,142 B2 * 2/2008 Vogel ..... 333/116

OTHER PUBLICATIONS

Dydyk, M., "Microstrip Directional Couplers with Ideal Performance via Single-Element Compensation," *IEEE Trans. Microwave Theory and Techniques*, 47(6):956-964 (1999).
March, S.L., "Phase Velocity Compensation in Parallel-Coupled Microstrip," *IEEE MTT-S Digest*, pp. 410-412 (1982).
Paolino, D. D., "MIC Overlay Coupler Design Using Spectral Domain Techniques," *IEEE Trans. Microwave Theory and Techniques*, MTT-26(9):646-649 (1978).
Podell, A., "A high directivity microstrip coupler technique," *IEEE MTT-S Symp. Digest*, pp. 33-36 (1970).
U.S. Appl. No. 11/747,053, Notice of Allowance dated Jan. 29, 2008, 7 pages.

* cited by examiner

*Primary Examiner*—Dean O Takaoka
(74) *Attorney, Agent, or Firm*—Townsend and Townsend and Crew LLP

(57) ABSTRACT

A coupler includes a substrate and a stack of first and second dielectric layers extending over a top surface of the substrate. The first dielectric layer comprises different dielectric material than the second dielectric layer. Two conductive lines extend over the stack of first and second dielectric layers, and are formed in the same plane parallel to a surface of the substrate.

42 Claims, 10 Drawing Sheets

HIGH DIRECTIVITY ULTRA-COMPACT COUPLER

BACKGROUND OF THE INVENTION

This invention relates to microwave coupler technology, and more particularly to a high directivity, low insertion loss, ultra-compact coupler and method of manufacturing the same.

Couplers are typically used in applications such as GSM/CDMA, WLAN 802.11a/b/g, and WiMax 802.16d/e to monitor the output power level of a power amplifier (PA) module. Minimizing coupler insertions loss is critical for maximizing PA efficiency especially for battery powered hand held devices. Improved coupler directivity is required to more accurately provide closed loop power control feedback to the base-band when the hand held device is subjected to mismatch conditions.

Conventional CDMA/GSM and WLAN modules use discrete band-limited thin film ceramic couplers in radio chipsets which have high insertion loss and consume substantial board space. Also, conventional WLAN RF power amplifier modules use on-chip resistive and/or capacitive coupling. This approach results in a large variation detector voltage error due to voltage standing wave ratio (VSWR) mismatch.

In other known coupler designs with microstrip transmission lines, the transmission lines have an inhomogeneous dielectric which is partly dielectric substrate and partly air. This inhomogeneous medium results in unequal odd and even mode phase velocities. The difference in the odd and even mode phase velocities causes poor coupler directivity when the coupled length is less than a quarter wavelength.

Several techniques for improving coupler directivity have been proposed. In one approach, the gap between coupled lines is serrated to slow down the odd mode phase velocity without affecting the even mode phase velocity. In another approach, lumped capacitors/inductors are added at each end of the coupler to make even and odd mode phase velocity equal at a particular frequency and improve isolation and directivity. In yet another approach, multiple dielectric permittivities and thicknesses are chosen in a multi-layer substrate stack-up to achieve improved directivity with overlapping quarter wavelength transmission lines. While these and other known techniques may improve upon various performance parameters, no technique has yet been disclosed which can yield a broadband coupler with high directivity, low insertion loss, and small footprint that can be monolithically integrated in a RF integrated circuit.

Thus, there is a need for a broadband monolithic coupler with high directivity, low insertion loss and a compact layout, and a method of manufacturing the same.

BRIEF SUMMARY OF THE INVENTION

In accordance with an embodiment of the invention, a coupler includes a substrate and a stack of first and second dielectric layers extending over a top surface of the substrate. The first dielectric layer comprises different dielectric material than the second dielectric layer. Two conductive lines extend over the stack of first and second dielectric layers, and are formed in the same plane parallel to a surface of the substrate.

In one embodiment, the substrate comprises gallium arsenide, the first dielectric layer comprises silicon nitride, and the second dielectric layer comprises polyimide.

In another embodiment, the substrate comprises silicon, the first dielectric layer comprises silicon nitride, and the second dielectric layer comprises benzocyclobutene.

In another embodiment, the substrate comprises one of alumina, silicon carbide, and indium phosphide.

In yet another embodiment, a conductive ground plate extends under both conductive lines and electrically contacts a bottom surface of the substrate.

In accordance with another embodiment of the invention, a coupler includes a substrate and a stack of first and second dielectric layers extending over a top surface of the substrate. The first dielectric layer comprises different dielectric material than the second dielectric layer. Two conductive lines extend over the stack of first and second dielectric layers, and a conductive ground plane extends under both conductive lines.

In accordance with yet another embodiment of the invention, a manufacturing process for forming a coupler includes the following steps. A first dielectric material is formed over a top surface of a substrate. A second dielectric material different from the first dielectric material is formed over the first dielectric material. First and second conductive lines are simultaneously formed over the second dielectric layer.

In one embodiment, the substrate comprises gallium arsenide, the first dielectric material comprises one or more layers of silicon nitride, and the second dielectric material comprises one or more layers of polyimide.

In another embodiment, the substrate comprises silicon, the first dielectric material comprises one or more layers of silicon nitride, and the second dielectric material comprises benzocyclobutene.

In another embodiment, the substrate comprises one of alumina, silicon carbide, and indium phosphide.

In yet another embodiment, a conductive ground plate is formed along a bottom surface of the substrate such that the conductive ground plate extends under both conductive lines.

Further features of the invention, its nature and various advantages will be more apparent from the accompanying drawings and the following detailed description of embodiments of the invention.

DETAILED DESCRIPTION OF THE INVENTION

In accordance with embodiments of the invention, a microwave coupler capable of covering multiple bands, offers low insertion loss and high directivity, has a compact layout, and can be monolithically integrated in the IC of a target application. In one embodiment, the coupler is implemented using GaAs process and multi-layers of dielectric material. The coupler includes a multi-dielectric layer stack-up and coupled microstrip lines configured to form distributed microstrip transmission lines where the even and odd mode phase velocities are substantially equalized to achieve high directivity. The coupler has a coupling length significantly shorter than the conventional quarter wave length coupled line couplers.

The low insertion loss of the coupler of the present invention helps maximize the efficiency of a power amplifier which is very desirable particularly for such applications as battery powered hand held devices. Also, the high directivity of the coupler of the present invention helps to more accurately provide closed loop power control feedback to the base-band when the hand held device is subjected to mismatch conditions.

Figure 1A:
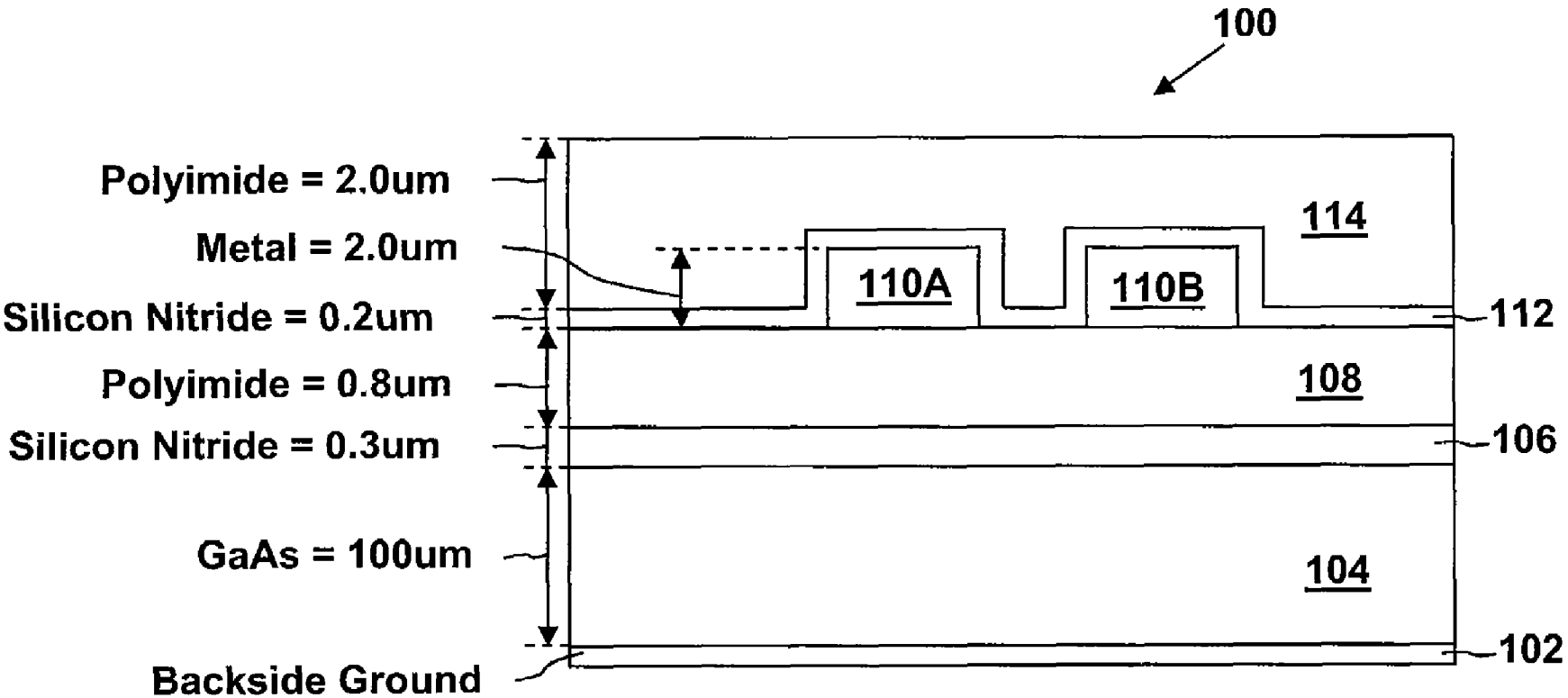
FIG. 1A shows a simplified cross section view of a multi-layer dielectric stack-up coupler 100 in accordance with an embodiment of the invention.
Figure 1B:
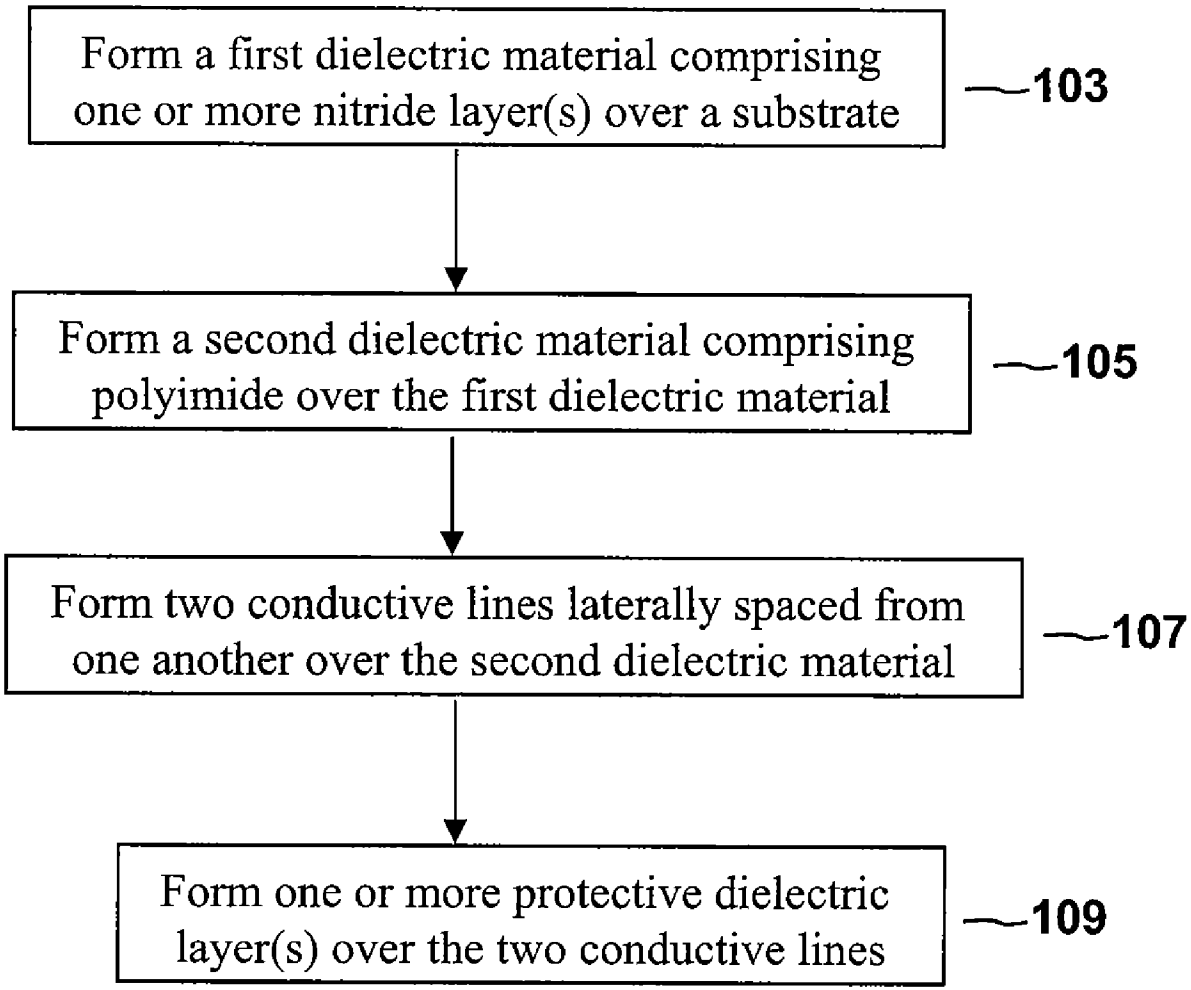
FIG. 1B is a flow chart setting forth a method of manufacturing the coupler 100 in FIG. 1A, in accordance with an embodiment of the invention.

FIG. 1A shows a simplified cross section view of a multilayer dielectric stack-up coupler 100 in accordance with an embodiment of the invention. FIG. 1B is a flow chart which will be used together with the cross section view in FIG. 1A to describe a method of manufacturing coupler 100 in FIG. 1A, in accordance with an embodiment of the invention. As depicted in FIG. 1A, a starting substrate material 104 comprising gallium arsenide (GaAs) with a dielectric constant (Er) of 12.9 is used. In one exemplary embodiment, GaAs substrate 104 has a thickness in the range of 80-120 μm (e.g., 100 μm). Other suitable starting substrate material, such as alumina with a dielectric constant of 9.8, silicon, indium phosphide or silicon carbide may also be used. If alumina is used, another dielectric layer (in addition to those shown in FIG. 1A) may be needed to obtain the same performance as the embodiment shown in FIG. 1A.

As shown in FIG. 1A and depicted by step 103 in FIG. 1B, a first dielectric material 106 is formed to extend over a top surface of starting substrate material 104 using conventional methods. In one exemplary embodiment, first dielectric material 106 comprises one or more silicon nitride layers with a dielectric constant of 6.8 and a total thickness in the range of 0.25-0.35 μm (e.g., 0.3 μm).

In step 105, a second dielectric material 108, different than first dielectric material 106, is formed to extend over the first dielectric material 106 using known techniques. In one exemplary embodiment, second dielectric material 108 comprises polyimide with a dielectric constant of 2.9 and a thickness in the range of 0.65-0.95 μm (e.g., 0.8 μm).

In step 107, two conductive lines 110A and 110B, optimally spaced from each other to obtain the desired coupling factor, are formed to extend over the second dielectric material 108 using conventional deposition and masking techniques. In one exemplary embodiment, conductive lines 110A, 110B comprise metal with a thickness in the range of 1.5-2.5 μm (e.g., 2.0 μm). As shown, conductive lines 110A, 110B are formed at the same time (e.g., when forming a single layer of metal) and thus extend in the same plane. Conductive lines 110A, 110B may have different or similar widths depending on the design goals. One of the conductive lines 110A, 110B serves as the coupled arm and the other as the thru arm of the coupler.

In step 109, one or more protective dielectric material(s) are formed over conductive lines 110A, 110B using known methods. In the embodiment shown in FIG. 1A, the protective dielectric material(s) include third and fourth dielectric layers 112 and 114. The third dielectric layer 112 overlies all exposed surfaces of the two conductive lines 110A, 110B and the exposed surfaces of second dielectric material 108. In one exemplary embodiment, third layer of dielectric material 112 comprises silicon nitride with a thickness in the range of 0.15-0.25 μm (e.g., 0.2 μm), and the fourth layer dielectric material 114 comprises polyimide with a thickness in the range of 1.5-2.5 μm (e.g., 2 μm). Note that the third and fourth dielectric layers 112, 114 serve to protect conductive lines 110A, 110B, and as such the type of dielectric material and their thickness is not critical to the proper operation of the coupler. Also, each of the four dielectric materials 106, 108, 112, 114 may comprise two or more dielectric layers of the same material depending on the process technology.

A highly conductive backside ground plate 102 (e.g., comprising metal) electrically contacting the backside of starting substrate material 104 is formed using known techniques. Ground plate 102 may be formed near the end of the manufacturing process, or at an earlier stage. In one embodiment, ground plate 102 is a gold-plated metal to obtain a highly conductive ground plate that does not readily oxidize. The resistance to oxidation eliminates the need for elaborate cleaning and storage procedures which facilitates the subsequent assembly of the integrated circuit chips.

The multilayer dielectric stack-up in FIG. 1A is advantageously configured such that the odd mode effective dielectric constant is increased thus reducing the odd mode phase velocity, and the even mode effective dielectric constant is slightly decreased thus increasing the even mode phase velocity. This results in an odd mode phase velocity that is substantially the same as the even mode phase velocity, which in turn provides improved coupler directivity.

Figure 2:
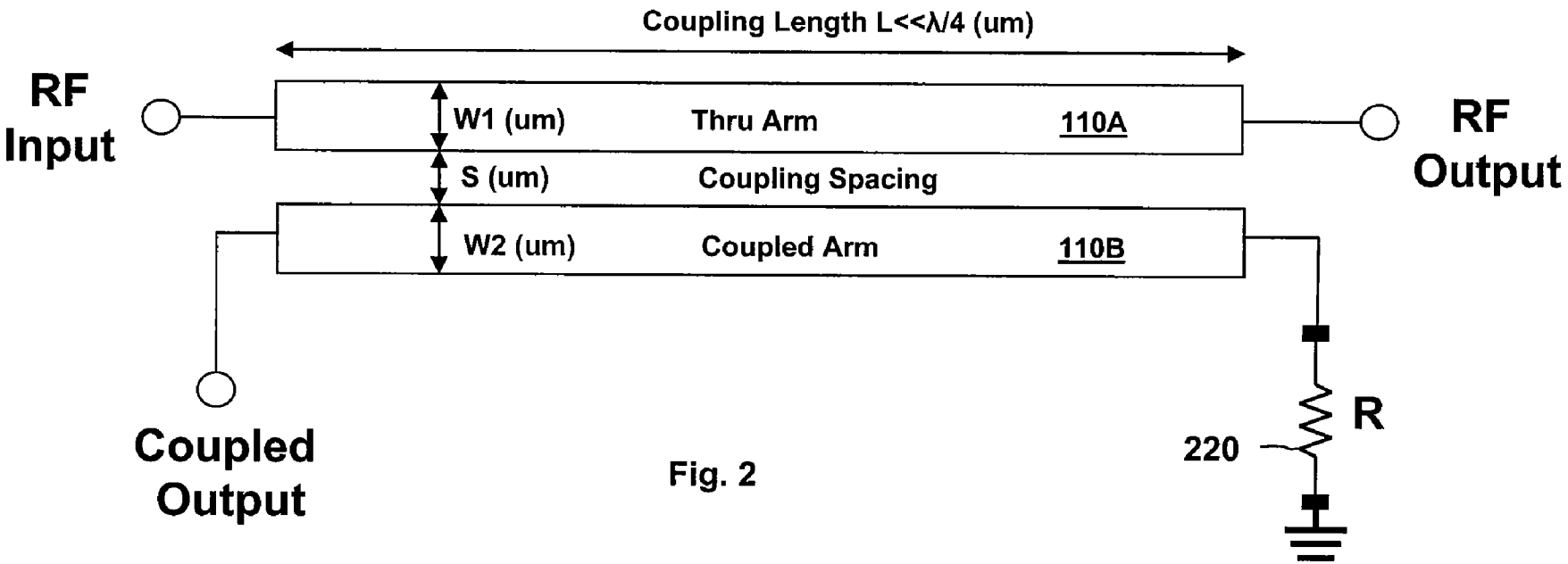
FIG. 2 shows a top plan view of the two conductive lines 110A, 110B in FIG. 1A, in accordance with an embodiment of the invention.

FIG. 2 shows a top plan view of the two conductive lines 110A, 110B. The upper line 110A functions as the thru arm with one end serving as the RF input port and the other end serving as the RF output port. The lower line 110B functions as the coupled arm with one end serving as the coupled output port and the other end serving as the isolated port which is terminated with a matched load 220 (typically a 50Ω resistor). The critical dimensional parameters are identified in the figure. A length of the thru arm 110A is indicated in the figure as the "coupling length L." In one embodiment, the coupling length L is considerably less than a quarter of a wavelength (e.g., by at least a factor 4). A width of each of thru arm 110A and couple arm 110B is marked in FIG. 2 as W1 and W2, respectively. A spacing between the two conductive lines is marked as spacing S. In one embodiment, resistor R is monolithically implemented using tantalum or other suitable material.

The dimensions W1, W2, S and L are the critical dimensional parameters which are carefully designed to achieve the desired performance for a given frequency of operation. In one embodiment where the coupler is designed for a 2.5 GHz application, W1 is set to a value in the range of 55-85 μm (e.g., 70 μm), W2 is set to a value in the range of 50-70 μm (e.g., 60 μm), S is set to a value in the range of 3-5 μm (e.g., 4 μm), and L is set to a value less than 1300 μm (e.g., 1100 μm which is one-thirty-second of a wavelength at 2.5 GHz operating frequency). The exemplary dimensions correspond to a coupling factor of −25 dB and directivity of 22-23 dB. Depending on the performance criteria, the above dimensional parameters may be adjusted. For example, for a lower frequency of operation a longer L and/or a smaller S may be used, and vice versa. In one embodiment, L is set to less than or equal to one-sixteenth of a wavelength at 5.5 GHz operating frequency.

From all the exemplary embodiments disclosed herein, one skilled in the art would be able to determine the appropriate value for the various dimensional parameters fro a given frequency operation.

Figure 3:
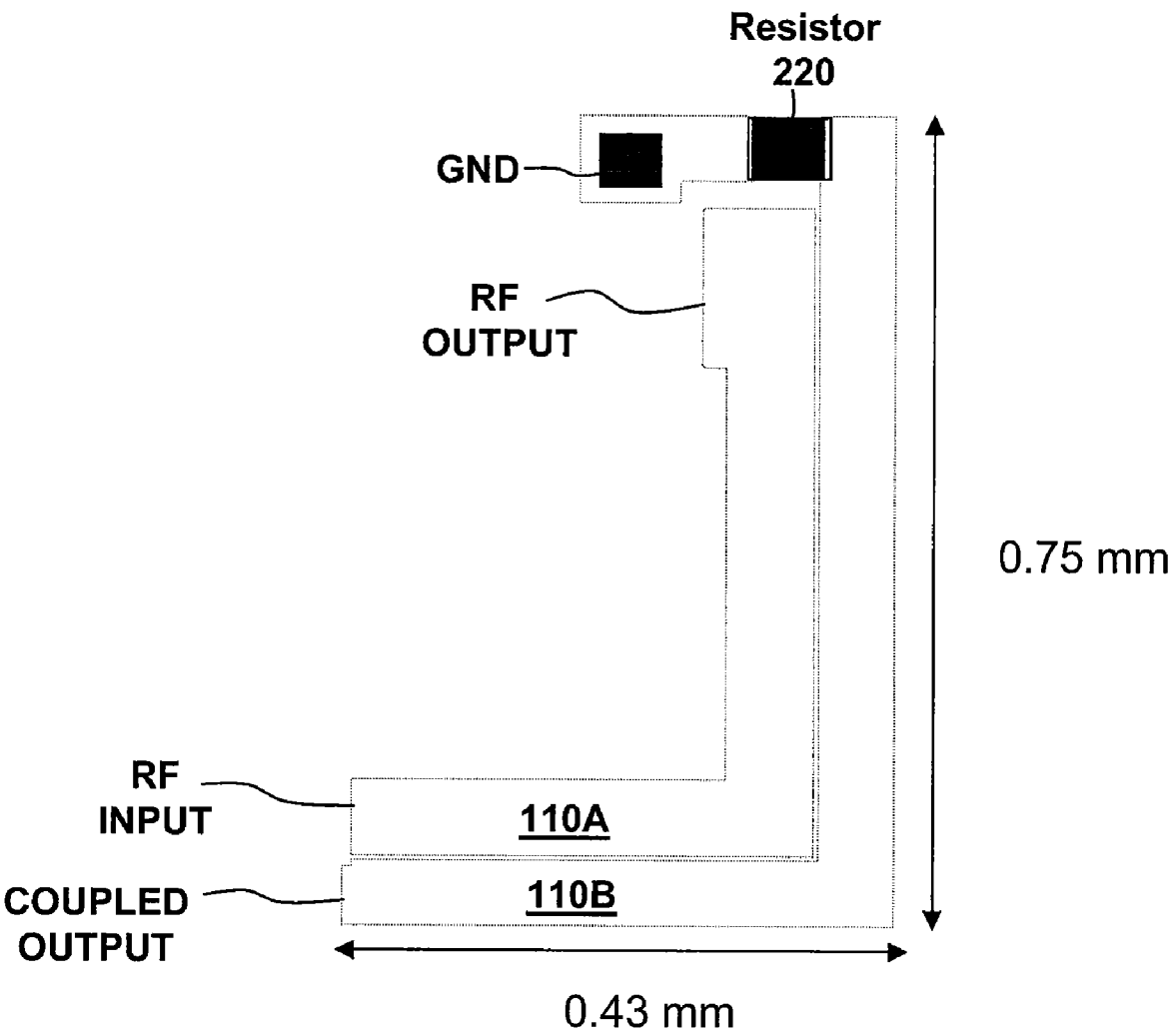
FIG. 3 shows a layout variation of the two conductive lines, in accordance with an embodiment of the invention.

While the two conductive lines 110A, 110B are shown to extend along a straight line, they may alternatively be shaped differently to, for example, accommodate die size or layout constraints. FIG. 3 shows one embodiment where the two conductive lines are bent 90°. Any other layout configuration, such as U-shaped or meandering lines may also be used, and as such the invention is not limited by the particular shape of the conductive lines.

Figure 4A:
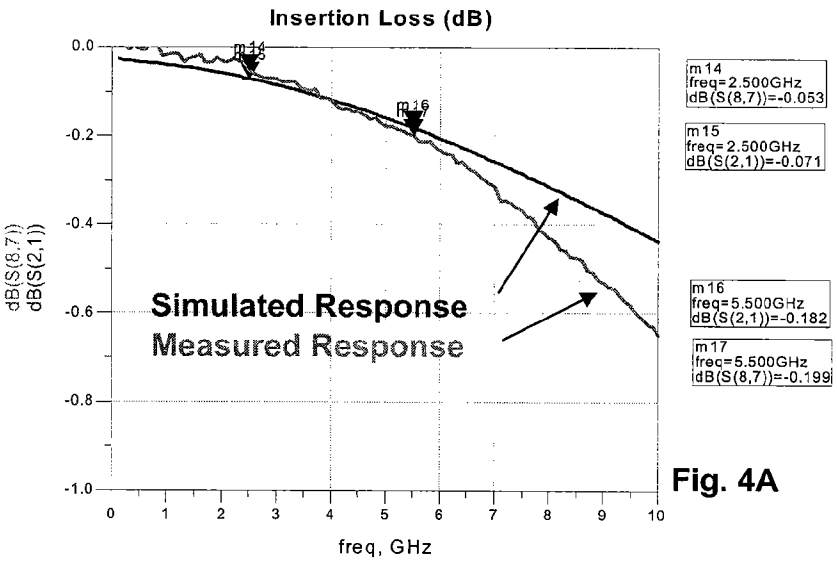
FIGS. 4A-4F show the measured versus simulated data for a number of parameters for an exemplary coupler, in accordance with an embodiment of the invention.
Figure 4B:
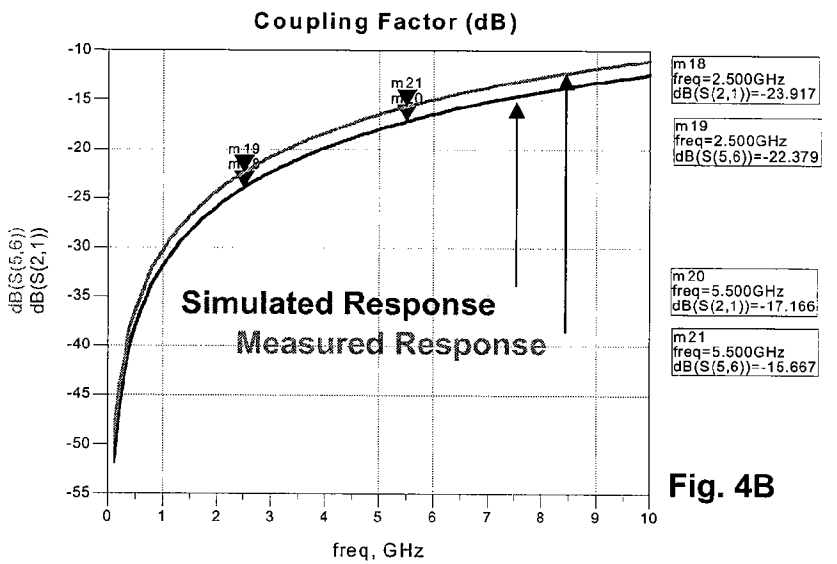
Figure 4C:
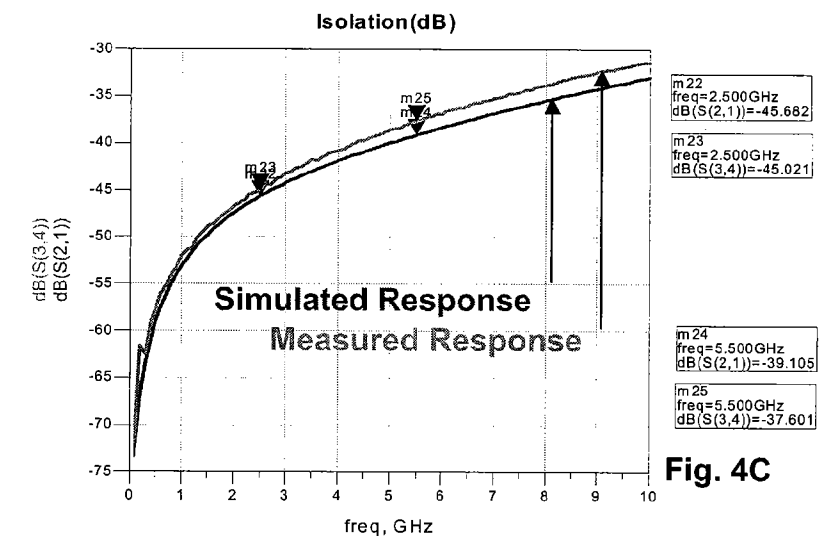
Figure 4D:
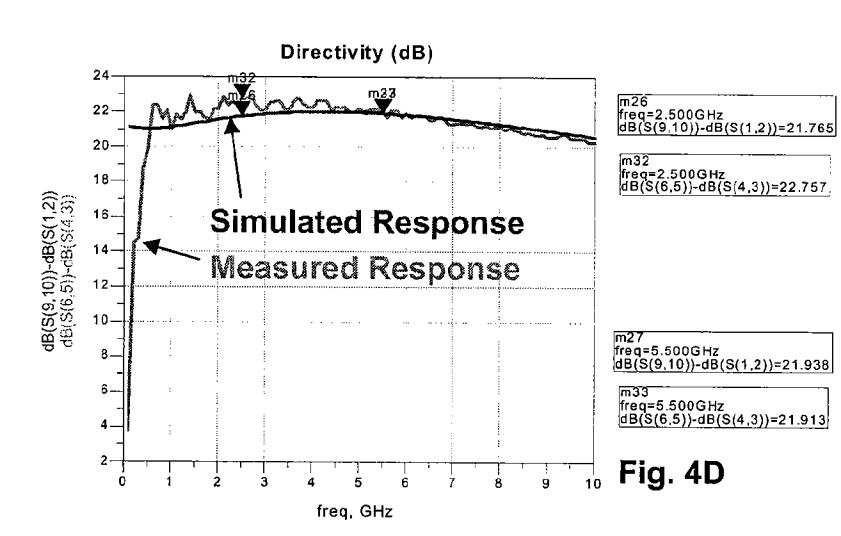
Figure 4E:
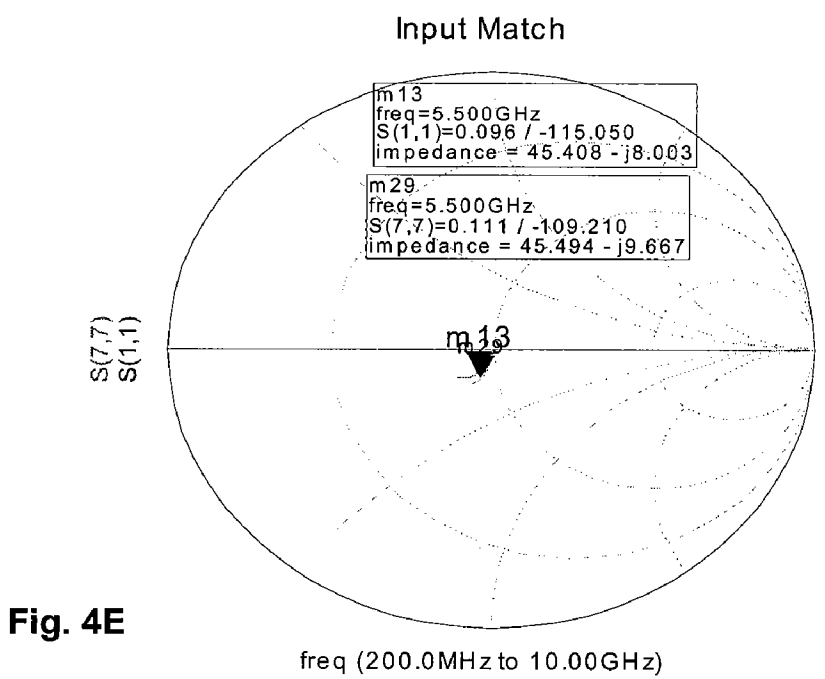
Figure 4F:
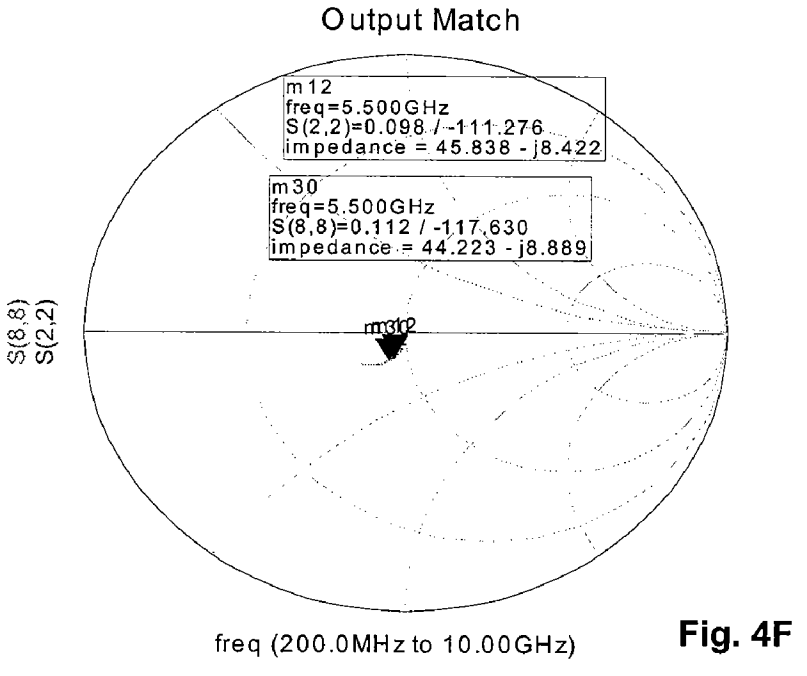

FIGS. 4A-4F show the measured versus simulated data for a number of parameters for an exemplary coupler designed and manufactured in accordance with the principles of the present invention. FIG. 4A graph is indicative of the insertion loss, FIG. 4B is indicative of the coupling factor, FIG. 4C is indicative of the coupler isolation, FIG. 4D is indicative of the coupler directivity, FIG. 4E shows the input match, and FIG. 4F shows the output match.

Figure 5:
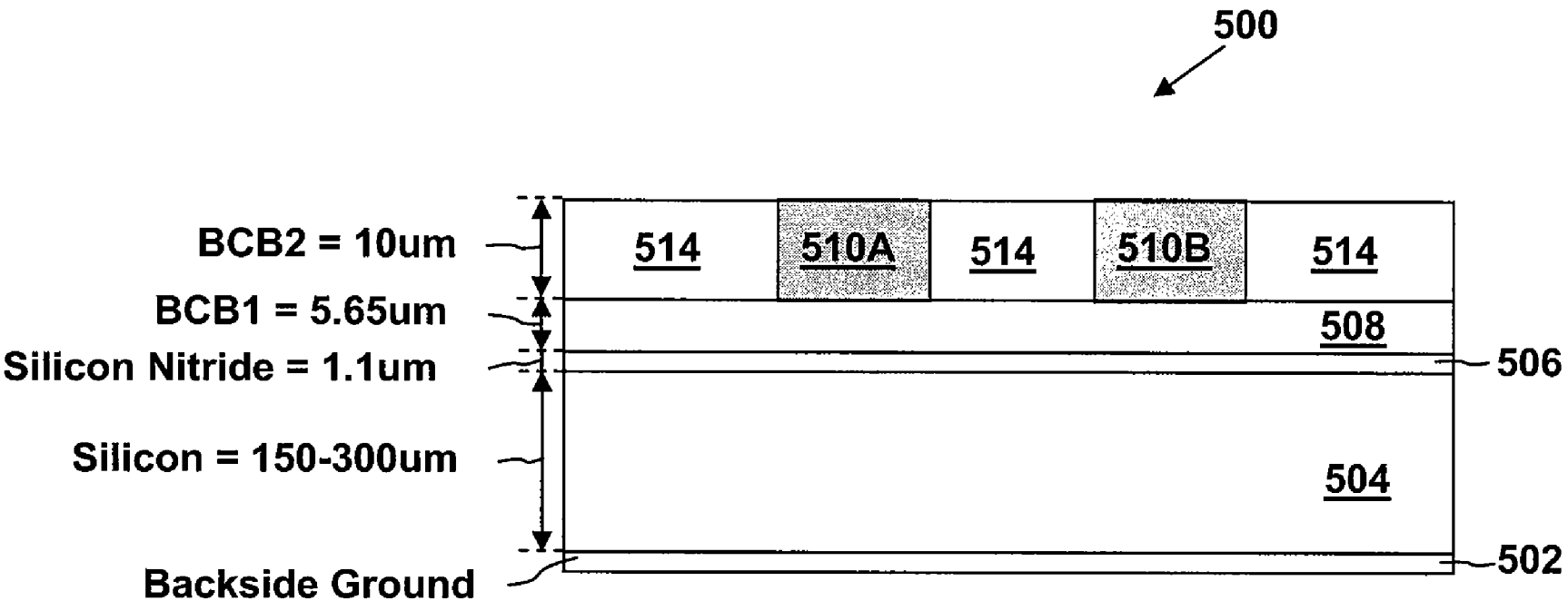
FIG. 5 shows a simplified cross section view of another multi-layer stack-up coupler 500 in accordance with another embodiment of the invention.

FIG. 5 shows a cross section view of another multi-layer stack-up coupler 500 in accordance with another embodiment of the invention. A starting substrate material 504 comprising silicon with a dielectric constant (Er) of 11.9 is used. In one exemplary embodiment, silicon substrate 504 has a thickness in the range of 150-300 μm. A first dielectric material 506 comprising silicon nitride with a dielectric constant of 6.8 and a thickness in the range of 0.9-1.3 μm (e.g., 1.1 μm) is formed to extend over silicon substrate material 504 using conventional methods.

A second dielectric material 508 comprising benzocyclobutene (BCB) with a dielectric constant of 2.65 and a thickness in the range of 4.5-6.5 μm (e.g., 5.65 μm) is formed to extend over the first dielectric material 506 using known techniques. A third dielectric material 514 also comprising BCB with a thickness in the range of 8-12 μm (e.g., 10 μm) is formed to extend over BCB material 508 using known techniques. Using conventional masking, patterning and etching methods, two openings are formed in upper BCB material 514, and are subsequently filled with conductive material (e.g., comprising metal) using know methods. Two conductive traces 510A, 510B of the same thickness as upper BCB layer 514 are thus formed. Conductive lines 510A, 510B are spaced from each other based on the desired coupling factor. As in the FIG. 1A embodiment, conductive lines 510A, 510B are formed at the same time (e.g., when forming a metal layer) and thus extend in the same plane.

One or more protective dielectric layers (not shown) may be formed over conductive lines 510A, 510B. A highly conductive backside ground plate 502 (e.g., comprising a metal) electrically contacting the backside of silicon substrate 504 is formed using known techniques. In one embodiment, ground plate 502 is gold-plated.

As in the FIG. 1A embodiment, the thicknesses for the various layers of material in FIG. 5 and the critical dimensional parameters W1, W2, L and S of conductive lines 510A, 510B may be set to equalize the modal velocities and to obtain the desired performance at a given frequency of operation. In one embodiment where coupler 500 is designed for a 2.5 GHz application, W1 is set to a value in the range of 55-85 μm (e.g., 70 μm), W2 is set to a value in the range of 50-70 μm (e.g., 60 μm), S is set to a value in the range of 3-5 μm (e.g., 4 μm), and L is set to a value less than 1300 μm (e.g., 1100 μm which is one-thirty-second of a wavelength at 2.5 GHz operating frequency). In another embodiment, L is advantageously set to less than or equal to one-sixteenth of a wavelength at 5.5 GHz operating frequency. Depending on the performance criteria, these dimensional parameters may be adjusted. For example, for a lower frequency of operation a longer L and/or a smaller S may be used, and vice versa.

Figure 6:
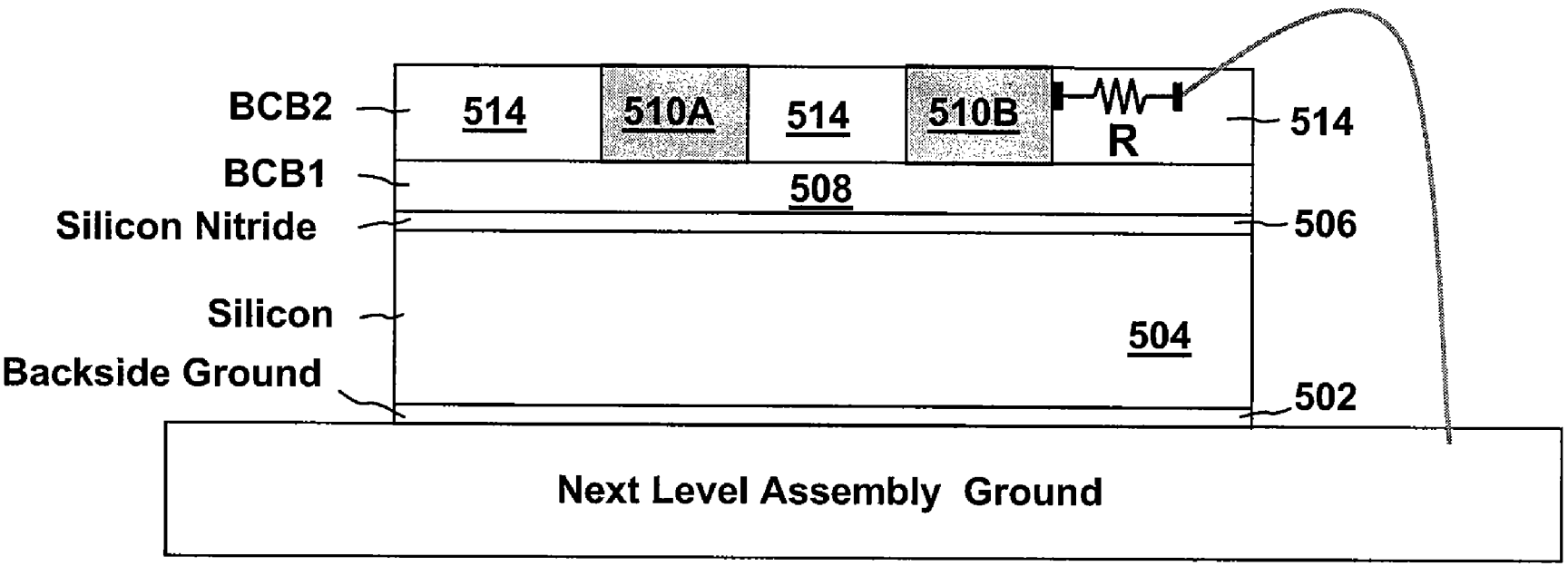
FIG. 6 shows how a ground connection needed along the top side of the substrate may be provided via a bond wire, in accordance with an embodiment of the invention.

Since through vias are difficult to form in silicon substrate 504, the top side ground connection to the termination resistor R may be made through a bond wire, as shown in FIG. 6.

Thus, a coupler in accordance with embodiments of the invention employs two coupled microstrip transmission lines fabricated on the same plane with at least two dielectric layers of different material extending below and one or more protective dielectric layers extending above the coupled microstrip transmission lines. A broad band, high directivity (e.g., 22 dB at 5.5 GHz) and low insertion loss (e.g., 0.2 dB at 5.5 Ghz) coupler is thus obtained that can operate at high frequencies (e.g., up to 10 GHz) and has a coupling length (e.g., less than one-sixteenth of a wavelength at 5.5 GHz) much smaller than and thus consumes far less area than prior art quarter wavelength couplers implemented at the same frequency band. The ultra-compact layout of the coupler together with its implementation in the same process technology used to manufacture monolithic microwave integrated circuit (MMIC) power amplifiers advantageously enables monolithic integration of the coupler and the MMIC power amplifier on a single MMIC chip. As compared to the prior art standalone ceramic couplers, the monolithically integrated coupler significantly reduces manufacturing cost. Further, the coupler of the present invention eliminates the lumped elements needed in some prior art approaches to compensate for phase velocity differences.

Moreover, the coupler in accordance with embodiments of the invention can be used in a variety of applications, such as CDMA, GSM, WLAN (e.g., 802.11a/b/g) and WiMax (e.g., 802.16d/e) applications. In accordance with measured data from an exemplary coupler design occupying only 0.3 $mm^2$ in die area, a minimum 20 dB directivity over about 10 GHz frequency bandwidth and an insertion loss of 0.2 dB up to 6.0 GHz (WLAN applications) was obtained.

Figure 7:
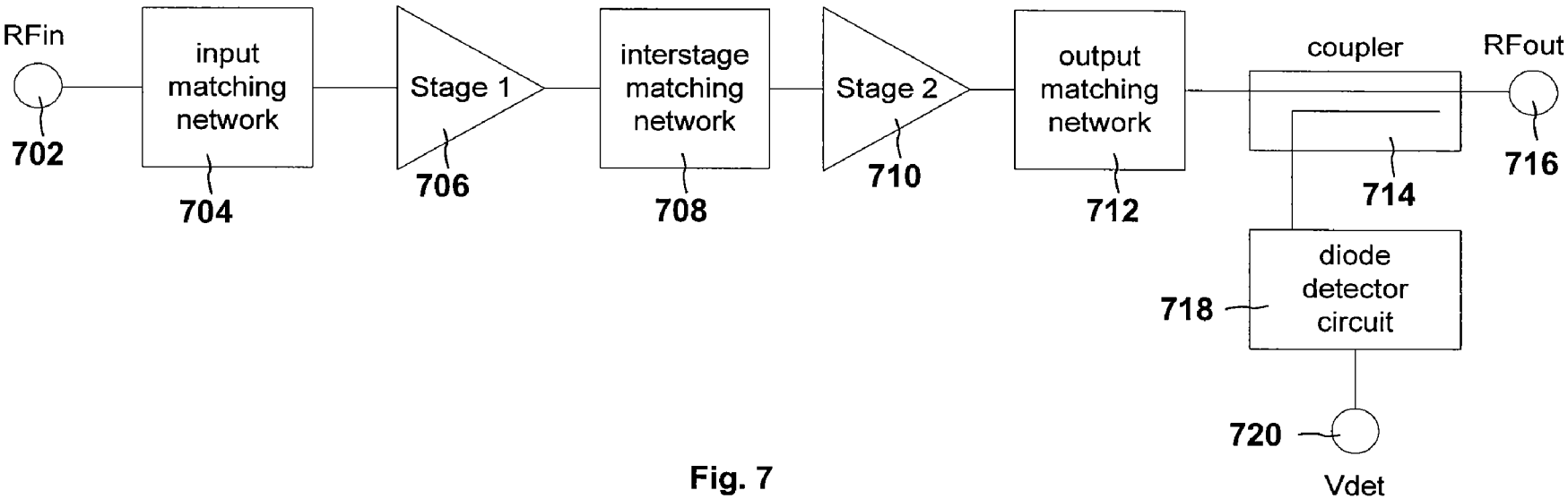
FIGS. 7 and 8 shows block diagrams for two of a number of possible applications where the coupler of the invention is optimally integrated, in accordance with embodiments of the invention.
Figure 8:
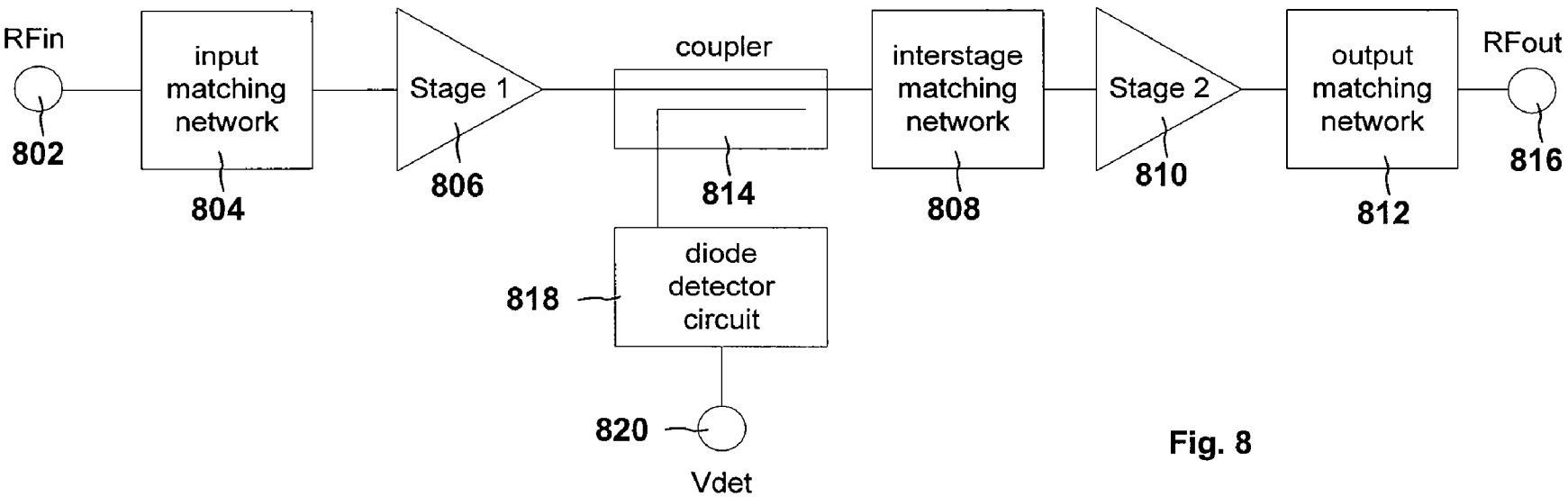

FIGS. 7 and 8 show block diagrams for two of a number of possible applications for the directional coupler of the present invention. In FIG. 7, the coupler 714 is used at the output of an amplifier after the second stage RF transistor 710 and the output matching network 712. Coupler 714 is configured to provide to a diode detector circuit 718 a sample of the RF power that is produced by the amplifier. The result is intended to be a DC voltage that is proportional to the transmitted RF power. In practice, the impedance presented to the RFout port 716 is variable. Unless coupler 714 has high directivity, the impedance variation can lead to erroneous detector output voltages.

Input matching network 704 is configured to transform the electrical impedance of the RF input port to the conjugate impedance of the active device in the first gain stage 706. This provides an impedance match that minimizes the amount of reflected power. In some applications, such as low noise amplifiers, an exact power match is not desired. In these applications the RF port impedance is transformed to another impedance that is presented to input of the active device for the purpose of a desired response such as minimum noise figure which is different from minimum reflection.

The first stage RF transistor 706 is configured to provide amplification of the RF signal that is received at RFin port. Interstage matching network 708 transforms the output impedance of the first stage transistor 706 to the conjugate of the input impedance of the second stage transistor 710. This impedance transformation is commonly called matching. It eliminates power reflections between the two active devices, thereby enhancing the efficiency and stability of the amplifier.

The second RF transistor 710 is configured to provide amplification of the signal that is presented to its input terminal. Output matching network 712 transforms the electrical impedance of the output device (i.e., second stage transistor 710 in this example) to the impedance that is presented to the RFout port 716. This is typically the characteristic impedance of the system which is often 50 or 75 Ohms.

The FIG. 8 block diagram shows another application where the coupler 814 is located between the two gain stages 806 and 810 of an amplifier. Again the coupler provides a sampled signal to a detector circuit 818. This arrangement is commonly used in a linearizer circuit, where the detector produces a voltage that is proportional to the RF power delivered to the following gain stage. The detected voltage is used to create a control signal that alters the operation of the final stage to keep its gain constant as the RF power varies. Once again, the dynamic load on the output of the coupler can lead to errors unless the coupler has high directivity.

The foregoing is merely illustrative of the principles of this invention and various modifications can be made by those skilled in the art in view of this disclosure without departing from the scope and spirit of the invention.

The invention claimed is:

1. A directional coupler comprising:

a substrate;

a first dielectric layer extending over a top surface of the substrate;

a second dielectric layer extending over the first dielectric layer, the first dielectric layer comprising a different dielectric material than the second dielectric layer;

two conductive lines extending over the second dielectric layer, wherein the two conductive lines are formed in the same plane parallel to a surface of the substrate; and a conductive ground plate extending under the two conductive lines.

2. The coupler of claim 1 wherein the substrate comprises gallium arsenide, the first dielectric layer comprises silicon nitride, and the second dielectric layer comprises polyimide.

3. The coupler of claim 2 wherein the substrate has a thickness in the range of 80-120 μm, the first dielectric layer has a thickness in the range of 0.25-0.35 μm, the second dielectric layer has a thickness in the range of 0.65-0.95 μm, and the two conductive lines comprise metal having a thickness in the range of 1.5-2.5 μm.

4. The coupler of claim 1 further comprising a stack of third and fourth dielectric layers extending over the two conductive lines to protect the two conductive lines.

5. The coupler of claim 4 wherein the third dielectric layer comprises silicon nitride and the fourth dielectric layer comprises polyimide.

6. The coupler of claim 1 wherein the substrate comprises silicon, the first dielectric layer comprises silicon nitride, and the second dielectric layer comprises benzocyclobutene.

7. The coupler of claim 6 wherein the substrate has a thickness in the range of 150-300 μm, the first dielectric layer has a thickness in the range of 0.9-1.3 μm, the second dielectric layer has a thickness in the range of 4.5-6.5 μm, and the two conductive lines comprise metal having a thickness in the range of 8-12 μm.

8. The coupler of claim 6 further comprising a third dielectric layer extending over the first and second dielectric layers and in between the two conductive lines, wherein the third dielectric layer comprises benzocyclobutene.

9. The coupler of claim 1 wherein the substrate comprises one of alumina, silicon carbide, and indium phosphide.

10. The coupler of claim 1 wherein the two conductive lines are laterally spaced from one anther so as to obtain a predetermined coupling factor.

11. The coupler of claim 1 wherein the ground plate electrically contacts a bottom surface of the substrate.

12. The coupler of claim 1 wherein:

one of the two conductive lines forms a thru arm with one end configured as an input port for receiving an RF input signal and another end configured as an output port for providing an RF output signal, and the other one of the two conductive lines forms a coupled arm with one end configured as a coupled port and another end configured as an isolation port to be terminated with a termination element.

13. The coupler of claim 12 wherein the thru arm has a width in the range of 55-85 μm and a coupled length in the range of 900-1300 μm, and the coupled arm has a width in the range of 50-70 μm, and the thru arm and the coupled arm are spaced from one another by a distance in the range of 3-6 μm.

14. The coupler of claim 12 wherein the thru arm has a coupled length less than one-sixteenth of a wavelength at 5.5 GHz operating frequency.

15. The coupler of claim 12 wherein the thru arm has a coupled length less than one-thirty-second of a wavelength at 2.5 GHz operating frequency.

16. A directional coupler comprising:

a substrate;

a first dielectric material extending over a top surface of the substrate;

a second dielectric material having a different dielectric constant than the first dielectric material, extending over the first dielectric material;

two conductive lines extending over the stack of first and second dielectric materials, wherein the two conductive lines are formed in the same plane parallel to a surface of the substrate; and a conductive ground plate extending under the two conductive lines.

17. The coupler of claim 16 wherein the substrate comprises gallium arsenide, the first dielectric material comprises one or more layers of silicon nitride, and the second dielectric material comprises one or more layers of polyimide.

18. The coupler of claim 16 wherein the substrate comprises silicon, the first dielectric material comprises one or more layers of silicon nitride, and the second dielectric material comprises benzocyclobutene.

19. The coupler of claim 16 wherein the ground plate electrically contacts a bottom surface of the substrate.

20. The coupler of claim 16 wherein:

one of the two conductive lines forms a thru arm with one end configured as an input port for receiving an RF input signal and another end configured as an output port for providing an RF output signal, and the other one of the two conductive lines forms a coupled arm with one end configured as a coupled port and another end configured as an isolation port to be terminated with a termination element.

21. The coupler of claim 20 wherein the thru arm has a coupled length less than one-sixteenth of a wavelength at 5.5 GHz operating frequency.

22. The coupler of claim 20 wherein the thru arm has a coupled length less than one-thirty-second of a wavelength at 2.5 GHz operating frequency.

23. A coupler comprising:

a substrate comprising gallium arsenide;

a first dielectric material extending over a top surface of the substrate, the first dielectric material comprising one or more layers of silicon nitride;

a second dielectric material extending over the first dielectric material, the second dielectric material comprising one or more layers of polyimide;

first and second conductive lines comprising metal, extending over the first and second dielectric material, wherein the two conductive lines are formed in the same plane parallel to a surface of the substrate; and a conductive ground plate extending under the first and second conductive lines.

24. The coupler of claim 23 wherein the substrate has a thickness in the range of 80-120 μm, the first dielectric material has a thickness in the range of 0.25-0.35 μm, the second dielectric material has a thickness in the range of 0.65-0.95 μm, and each of the two conductive lines has a thickness in the range of 1.5-2.5 μm.

25. The coupler of claim 23 further comprising:

a third dielectric material extending over the first and second conductive lines, the third dielectric material comprising a layer of silicon nitride; and a fourth dielectric material extending over the third dielectric material, the fourth dielectric material comprising polyimide.

26. The coupler of claim 23 wherein the ground plate electrically contacts a bottom surface of the substrate.

27. The coupler of claim 23 wherein:

one of the first and second conductive lines forms a thru arm with one end configured as an input port for receiving an RF input signal and another end configured as an output port for providing an RF output signal, and the other one of the first and second conductive lines forms a coupled arm with one end configured as a coupled port and another end configured as an isolation port to be terminated with a termination element.

28. The coupler of claim 27 wherein the thru arm has a width in the range of 55-85 μm and a coupled length in the range of 900-1300 μm, and the coupled arm has a width in the range of 50-70 μm, and the thru arm and the coupled arm are spaced from one another by a distance in the range of 3-6 μm.

29. The coupler of claim 27 wherein the thru arm has a coupled length less than one-sixteenth of a wavelength at 5.5 GHz operating frequency.

30. The coupler of claim 27 wherein the thru arm has a coupled length less than one-thirty-second of a wavelength at 2.5 GHz operating frequency.

31. A coupler comprising:

a substrate;

a first dielectric layer extending over a top surface of the substrate;

a second dielectric layer extending over the first dielectric layer, the first dielectric layer comprising a different dielectric material than the second dielectric layer;

two conductive lines extending over the second dielectric layer;

a conductive ground plane extending under the two conductive lines and electrically contacting a bottom surface of the substrate; and a stack of third and fourth dielectric layers extending over the two conductive lines to protect the two conductive lines.

32. The coupler of claim 31 wherein the substrate comprises gallium arsenide, the first dielectric layer comprises silicon nitride, and the second dielectric layer comprises polyimide.

33. The coupler of claim 32 wherein the substrate has a thickness in the range of 80-120 μm, the first dielectric layer has a thickness in the range of 0.25-0.35 μm, the second dielectric layer has a thickness in the range of 0.65 -0.95 μm, and the two conductive lines comprise metal having a thickness in the range of 1.5-2.5 μm.

34. The coupler of claim 31 wherein the third dielectric layer comprises silicon nitride and the fourth dielectric layer comprises polyimide.

35. The coupler of claim 31 wherein the substrate comprises silicon, the first dielectric layer comprises silicon nitride, and the second dielectric layer comprises benzocyclobutene.

36. The coupler of claim 35 wherein the substrate has a thickness in the range of 150-300 μm, the first dielectric layer has a thickness in the range of 0.9-1.3 μm, the second dielectric layer has a thickness in the range of 4.5-6.5 μm, and the two conductive lines comprise metal having a thickness in the range of 8-12 μm.

37. The coupler of claim 35 further comprising a fifth dielectric layer extending over the first and second dielectric layers and in between the two conductive lines, wherein the fifth dielectric layer comprises benzocyclobutene.

38. The coupler of claim 31 wherein the substrate comprises one of alumina, silicon carbide, and indium phosphide.

39. The coupler of claim 31 wherein:

one of the two conductive lines forms a thru arm with one end configured as an input port for receiving an RF input signal and another end configured as an output port for providing an RF output signal, and the other one of the two conductive lines forms a coupled arm with one end configured as a coupled port and another end configured as an isolation port to be terminated with a termination element.

40. The coupler of claim 39 wherein the thru arm has a width in the range of 55-85 μm and a coupled length in the range of 900-1300 μm, and the coupled arm has a width in the range of 50-70 μm, and the thru arm and the coupled arm are spaced from one another by a distance in the range of 3-6 μm.

41. The coupler of claim 39 wherein the thru arm has a coupled length less than one-sixteenth of a wavelength at 5.5 GHz operating frequency.

42. The coupler of claim 39 wherein the thru arm has a coupled length less than one-thirty-second of a wavelength at 2.5 GHz operating frequency.

* * * * *

UNITED STATES PATENT AND TRADEMARK OFFICE

CERTIFICATE OF CORRECTION

PATENT NO. : 7,564,325 B2
APPLICATION NO. : 11/675564
DATED : July 21, 2009
INVENTOR(S) : Hussain et al.

It is certified that error appears in the above-identified patent and that said Letters Patent is hereby corrected as shown below:

On the Title Page, item (73), Assignee: should read as follows:

(73) Assignee: --Fairchild Semiconductor Corporation--

Signed and Sealed this

Twenty-third Day of February, 2010

David J. Kappos

David J. Kappos
*Director of the United States Patent and Trademark Office*